US005621928A

United States Patent [19]

Willhight

[11] Patent Number: 5,621,928

[45] Date of Patent: Apr. 22, 1997

[54] BATH WATER RETAINER AND TOY

[76] Inventor: Bryan Willhight, 2330 63rd St., Everett, Wash. 98203

[21] Appl. No.: 689,596

[22] Filed: Aug. 12, 1996

[51] Int. Cl.[6] ..... A47K 4/00

[52] U.S. Cl. ..... 4/559; 4/661; 446/153; 446/217; 446/227

[58] Field of Search ..... 4/546, 559, 591, 4/637, 644, 648, 653, 658, 659, 661; 446/153, 217, 218, 227

[56] References Cited

U.S. PATENT DOCUMENTS

| | | | |
|---|---|---|---|
| D. 261,028 | 9/1981 | Bitvai | 4/659 |
| 2,635,253 | 4/1953 | Kirvay | 4/658 |
| 2,896,895 | 7/1959 | Speese | 4/559 |
| 3,444,564 | 5/1969 | Lavacchia | 4/559 |
| 4,620,332 | 11/1986 | Laird | 4/546 |
| 4,910,815 | 3/1990 | Kelley | 4/661 |
| 4,937,897 | 7/1990 | Barnabie | 4/559 |
| 5,078,642 | 1/1992 | Glessner | 4/546 |
| 5,381,564 | 1/1995 | Carroll | 4/559 |
| 5,385,472 | 1/1995 | Mullin | 446/153 |

*Primary Examiner*—Renee S. Luebke
*Assistant Examiner*—Charles R. Eloshway

[57] ABSTRACT

A new Bath Water Retainer and Toy for diverting bath water back into the bath tub while providing entertainment to a bathing child, thereby preventing water damage to the floor surrounding the bath tub. The device includes a first L-shaped member which removably couples to a bath tube edge, a water retaining wall along the edge of the first L-shaped member and projecting orthogonally, a second L-shaped member pivotally secured to the first L-shaped member providing a ledge within the interior portion of the bath tub for the child to place toys upon, a water collecting tray which captures water from the first L-shaped member and dispenses it through a water outlet nozzle in a stream, and at least one water wheel secured to the vertical portion of the second L-shaped member which receives the stream of water and rotates providing entertainment to the bathing child.

6 Claims, 3 Drawing Sheets

FIG 1
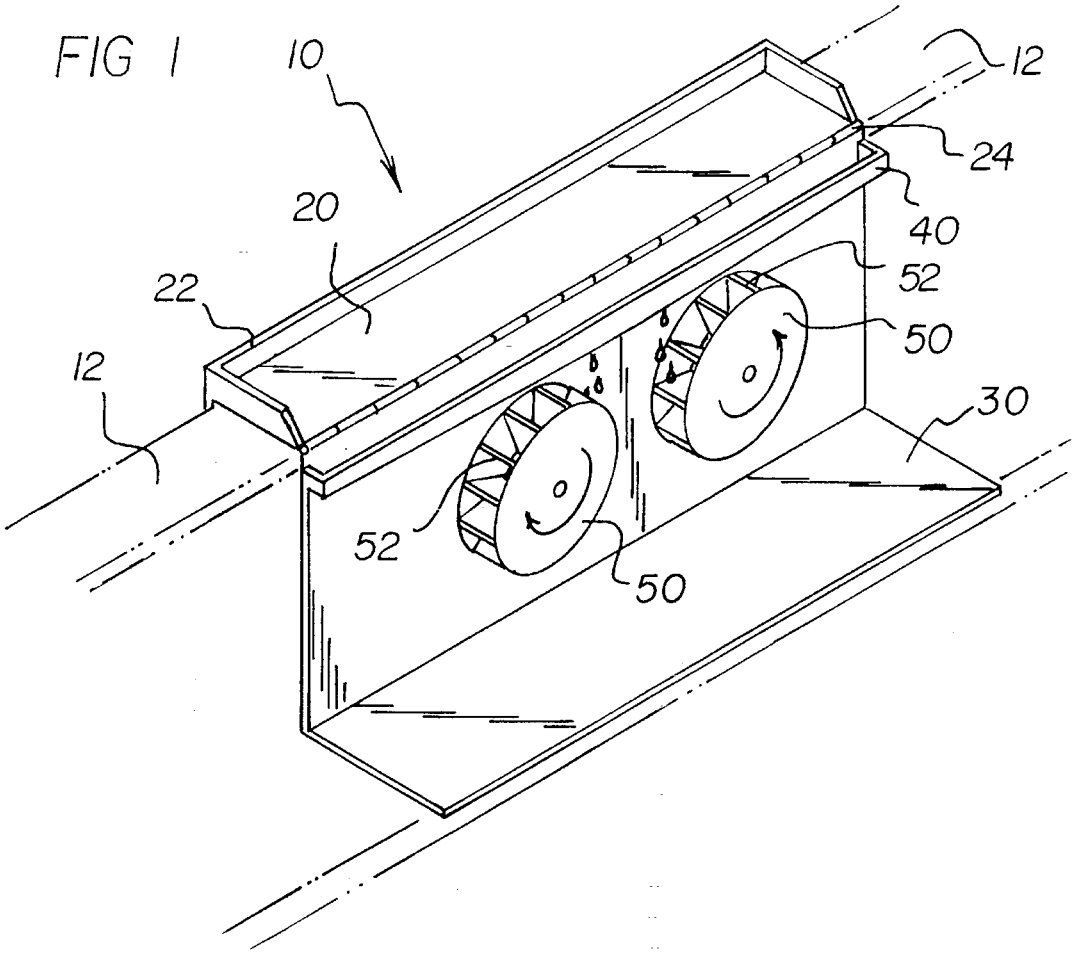
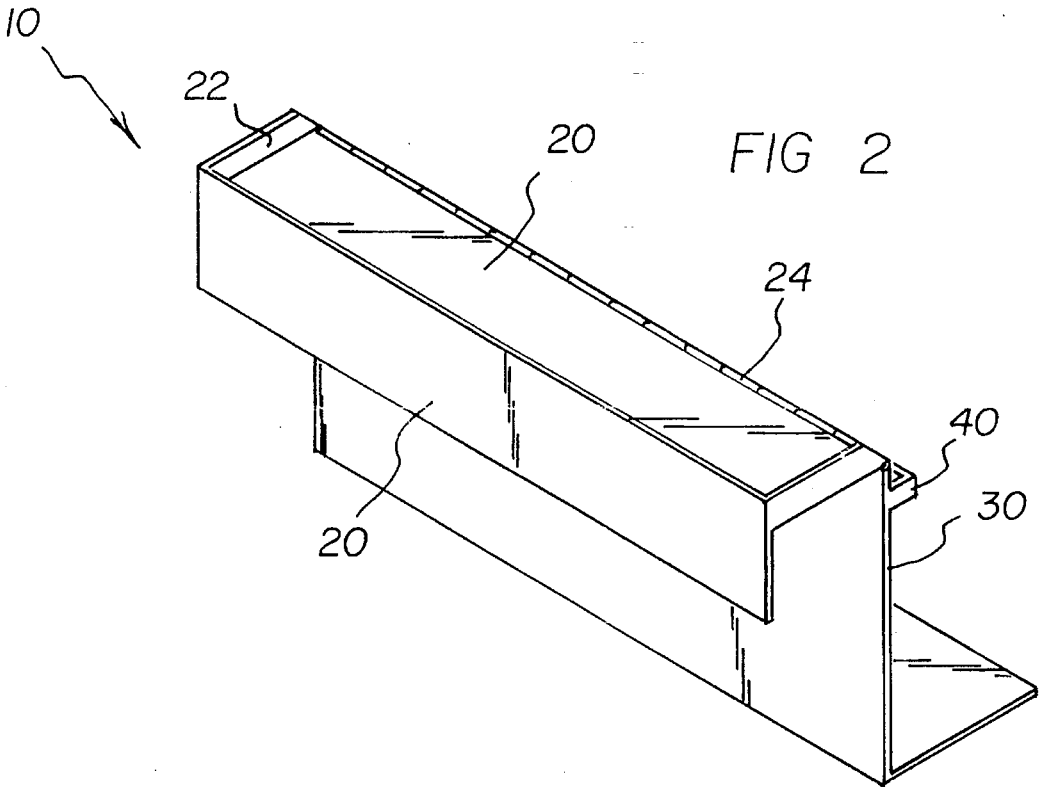
FIG 2

FIG 5
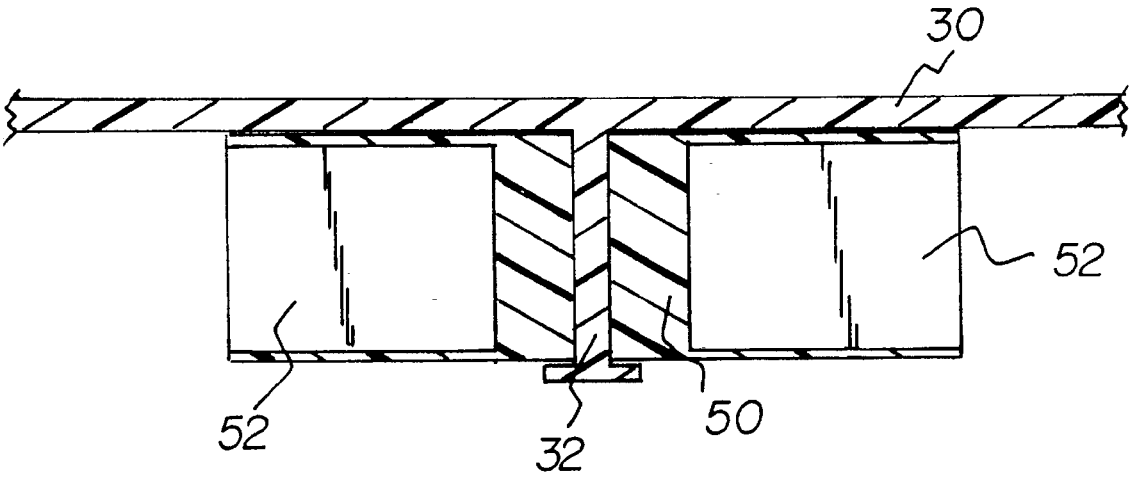
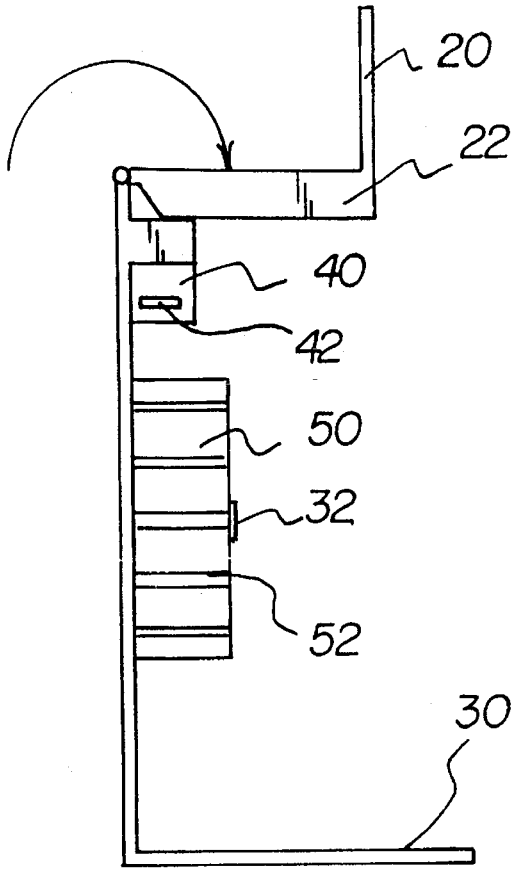
FIG 6

BATH WATER RETAINER AND TOY

BACKGROUND OF THE INVENTION

1. Field of the Invention

The present invention relates to Bath Tub Devices and more particularly pertains to a new Bath Water Retainer and Toy for diverting bath water back into the bath tub while providing entertainment to a bathing child, thereby preventing water damage to the floor surrounding the bath tub.

2. Description of the Prior Art

The use of Bath Tub Devices is known in the prior art. More specifically, Bath Tub Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Bath Tub Devices include U.S. Pat. No. 5,365,619; U.S. Pat. No. 5,381,564; U.S. Design Pat. No. 264,158; U.S. Pat. No. 5,357,639; U.S. Pat. No. 5,313,675 and U.S. Pat. No. 4,878,257.

While these devices fulfill their respective, particular objectives and requirements, the aforementioned patents do not disclose a new Bath Water Retainer and Toy. The inventive device includes a first L-shaped member which removably couples to a bath tub edge, a water retaining wall along the edge of the first L-shaped member and projecting orthogonally, a second L-shaped member pivotally secured to the first L-shaped member providing a ledge within the interior portion of the bath tub for the child to place toys upon, a water collecting tray which captures water from the first L-shaped member and dispenses it through a water outlet nozzle in a stream, and at least one water wheel secured to the vertical portion of the second L-shaped member which receives the stream of water and rotates providing entertainment to the bathing child.

In these respects, the Bath Water Retainer and Toy according to the present invention substantially departs from the conventional concepts and designs of the prior art, and in so doing provides an apparatus primarily developed for the purpose of diverting bath water back into the bath tub while providing entertainment to a bathing child, thereby preventing water damage to the floor surrounding the bath tub.

SUMMARY OF THE INVENTION

In view of the foregoing disadvantages inherent in the known types of Bath Tub Devices now present in the prior art, the present invention provides a new Bath Water Retainer and Toy construction wherein the same can be utilized for diverting bath water back into the bath tub while providing entertainment to a bathing child, thereby preventing water damage to the floor surrounding the bath tub.

The general purpose of the present invention, which will be described subsequently in greater detail, is to provide a new Bath Water Retainer and Toy apparatus and method which has many of the advantages of the Bath Tub Devices mentioned heretofore and many novel features that result in a new Bath Water Retainer and Toy which is not anticipated, rendered obvious, suggested, or even implied by any of the prior art Bath Tub Devices, either alone or in any combination thereof.

To attain this, the present invention generally comprises a first L-shaped member which removably couples to a bath tub edge, a water retaining wall along the edge of the first L-shaped member and projecting orthogonally, a second L-shaped member pivotally secured to the first L-shaped member providing a ledge within the interior portion of the bath tub for the child to place toys thereupon, a water collecting tray which captures water from the first L-shaped member and dispenses it through a water outlet nozzle in a stream, and at least one water wheel secured to the vertical portion of the second L-shaped member which receives the stream of water and rotates providing entertainment to the bathing child.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Bath Water Retainer and Toy apparatus and method which has many of the advantages of the Bath Tub Devices mentioned heretofore and many novel features that result in a new Bath Water Retainer and Toy which is not anticipated, rendered obvious, suggested, or even implied by any of the prior art Bath Tub Devices, either alone or in any combination thereof.

It is another object of the present invention to provide a new Bath Water Retainer and Toy which may be easily and efficiently manufactured and marketed.

It is a further object of the present invention to provide a new Bath Water Retainer and Toy which is of a durable and reliable construction.

An even further object of the present invention is to provide a new Bath Water Retainer and Toy which is susceptible of a low cost of manufacture with regard to both materials and labor, and which accordingly is then susceptible of low prices of sale to the consuming public, thereby making such Bath Water Retainer and Toy economically available to the buying public.

Still yet another object of the present invention is to provide a new Bath Water Retainer and Toy which provides in the apparatuses and methods of the prior art some of the advantages thereof, while simultaneously overcoming some of the disadvantages normally associated therewith.

Still another object of the present invention is to provide a new Bath Water Retainer and Toy for diverting bath water back into the bath tub while providing entertainment to a bathing child, thereby preventing water damage to the floor surrounding the bath tub.

Yet another object of the present invention is to provide a new Bath Water Retainer and Toy which includes a first L-shaped member which removably couples to a bath tub edge, a water retaining wall along the edge of the first L-shaped member and projecting orthogonally, a second L-shaped member pivotally secured to the first L-shaped member providing a ledge within the interior portion of the bath tub for the child to place toys upon, a water collecting tray which captures water from the first L-shaped member and dispenses it through a water outlet nozzle in a stream, and at least one water wheel secured to the vertical portion of the second L-shaped member which receives the stream of water and rotates providing entertainment to the bathing child.

Still yet another object of the present invention is to provide a new Bath Water Retainer and Toy that diverts water back into the bath tub that is splashed by a child.

Even still another object of the present invention is to provide a new Bath Water Retainer and Toy that allows children to position toys thereupon for storage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front perspective view of a new Bath Water Retainer and Toy according to the present invention.

FIG. 2 is a rear perspective view thereof.

FIG. 5 is a cross sectional view taken along line 5—5 of FIG. 4.

FIG. 6 is a side view of the present invention.

DESCRIPTION OF THE PREFERRED EMBODIMENT

Figure 3:
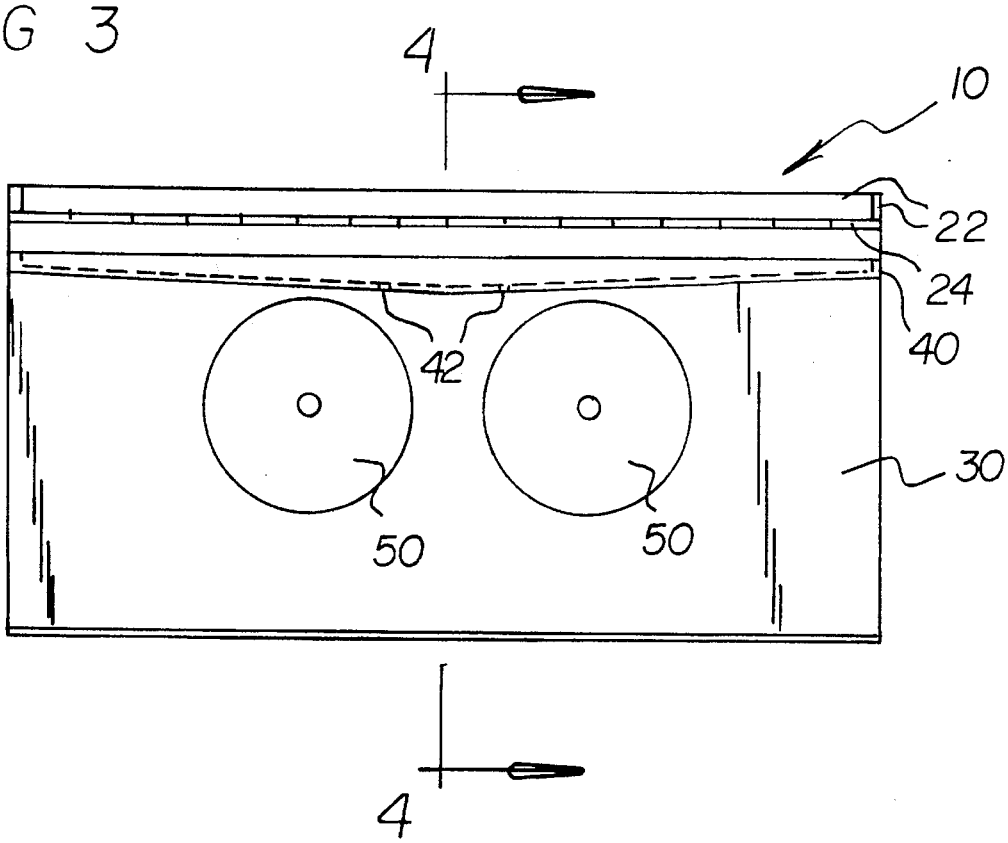
FIG. 3 is a front view of the present invention.
Figure 4:
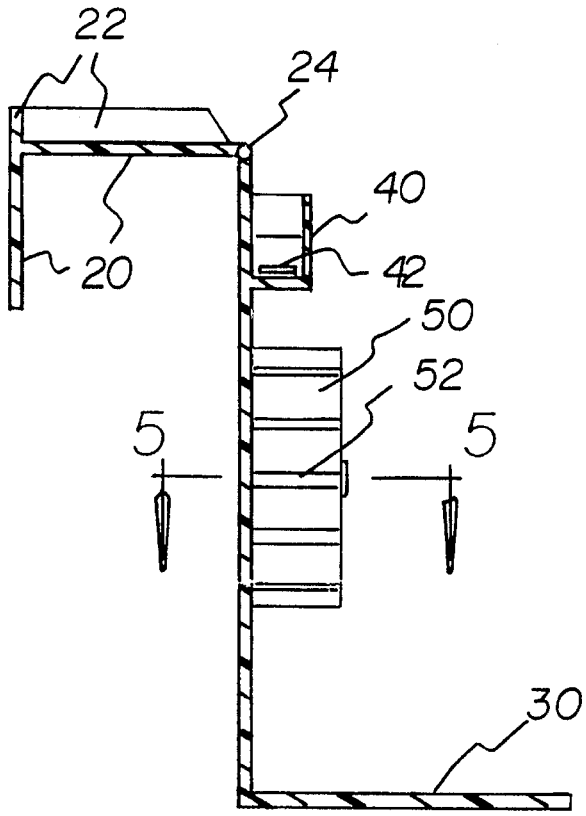
FIG. 4 is a cross sectional view taken along line 4—4 of FIG. 3.

With reference now to the drawings, and in particular to FIGS. 1 through 6 thereof, a new Bath Water Retainer and Toy embodying the principles and concepts of the present invention and generally designated by the reference numeral 10 will be described.

More specifically, it will be noted that the Bath Water Retainer and Toy 10 comprises a first L-shaped member 20 which is formed to engage a bath tub edge 12 on the cornice and the exterior side, a hinge 24 secured to the edge of the first L-shaped member 20 opposite of the exterior side, a water retaining wall 22 projecting vertically upward secured around the edge of the horizontal portion forming a U-shape where the open portion is in aposition to the interior of the bath tub, a second L-shaped member 30 secured at one end to the hinge 24, where the opposite orthogonally projecting portion projects horizontally into the interior of the bath tub, and a water collecting tray 40 secured to the vertical portion of the second L-shaped member 30 receiving water diverted from the first L-shaped member 20.

As best illustrated in FIG. 3, it can be shown that the water collecting tray 40 has a bottom which is syncline shaped with the center being the lowest part. The water collecting tray 40 includes at least one water outlet nozzle 42 near the center of the syncline shaped bottom which releases the water collected. The second L-shaped member 30 includes at least one axle 32 secured orthogonally to the vertical portion. A water wheel 50 is rotatably positioned around the axle 32. The water dispensed through the water outlet nozzle 42 projects towards the water wheel 50 engaging a plurality of paddles 52 of the water wheel 50 thereby rotating the water wheel 50. Preferably as shown in FIG. 3 of the drawings, there are a pair of water outlet nozzles 42 positioned about the center of the syncline shaped bottom of the water collecting tray 40. As shown in FIGS. 1 and 3 of the drawings, there preferably are a pair of axles 32 secured to the vertical portion of the second L-shaped member 30. Preferably, there a pair of water wheels 50 rotatably positioned to the pair of axles 32. The water wheels 50 receive the water from the pair of water outlet nozzles 42 and rotate thereby. The present invention is preferably constructed from resilient plastic.

In use, the bathing child positions toys about the lower horizontal edge of the second L-shaped member 30. When the child splashes water or pours water into the first L-shaped member 20, the water is retained by the water retaining wall 22 thereby preventing the water from emitting onto the floor of the bathroom. The collected water then dispenses into the water collecting tray 40. The water flows towards the central portion because of the unnumbered syncline shaped bottom. The water then flows through the water outlet nozzles 42 and engage the water wheels 50. The water engages the paddles 52 thereby applying torque to the water wheels 50 which rotates the water wheels 50. The water is then released near the bottom portion of the water wheel 50 thereby flowing back into the interior portion of the bath tub.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A Bath Water Retainer and Toy for use in a bathtub comprising:

a first L-shaped member, one leg of said L-shaped member adapted to lie against an exterior side of a bathtub sidewall, the other leg of said L-shaped member adapted to overlie a cornice of said sidewall;

a hinge secured to a terminal edge of said other leg of said L-shaped member;

a water retaining wall projecting vertically upward from said other leg of said L-shaped member and extending around a perimeter thereof so as to form a U-shape, wherein an open portion of said U-shape is adapted to face into said bathtub;

a second L-shaped member having first and second legs, said second L-shaped member secured to said hinge at a terminal end of said first leg, said first leg adapted to overlie an interior side of said sidewall and said second leg projecting orthogonally from said first leg into an interior of said tub;

a water collecting tray secured to said first leg of said second L-shaped member for receiving water therein diverted from said water retaining wall, said water collecting tray having at least one water outlet nozzle therein; and, at least one water wheel rotatably positioned on said first leg of said second L-shaped member below said water collecting tray such that water dispensed through said at least one water outlet nozzle falls onto said at least one water wheel to thereby rotate said at least one wheel.

2. The Bath Water Retainer and Toy of claim 1, wherein the water collecting tray has a bottom which is syncline shaped so as to channel water collected thereby to a lowermost part thereof.

3. The Bath Water Retainer and Toy of claim 2, wherein the at least one water outlet nozzle is located in said lowermost part of said bottom near a center thereof.

4. The Bath Water Retainer and Toy of claim 3, wherein there are a pair of water outlet nozzles positioned about the center of the syncline shaped bottom of the water collecting tray.

5. The Bath Water Retainer and Toy of claim 4, wherein there are a pair of axles secured to the first leg portion of the second L-shaped member below said water collecting tray, whereby a pair of water wheels are rotatably connected to the pair of axles and receive water from the pair of water outlet nozzles so as to rotate said wheels.

6. The Bath Water Retainer and Toy of claim 5, wherein said Bath Water Retainer and Toy is constructed from resilient plastic.

* * * * *